US006634920B1

(12) United States Patent
Michaelsen

(10) Patent No.: US 6,634,920 B1
(45) Date of Patent: Oct. 21, 2003

(54) THERMOFORMED TOY BUILDING PLATE

(75) Inventor: Carsten Peter Michaelsen, Charlottenlund (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/508,808

(22) PCT Filed: Sep. 17, 1998

(86) PCT No.: PCT/DK98/00398

§ 371 (c)(1),
(2), (4) Date: Jul. 10, 2000

(87) PCT Pub. No.: WO99/13953

PCT Pub. Date: Mar. 25, 1999

(30) Foreign Application Priority Data

Sep. 10, 1997 (DK) ..... 1070/97

(51) Int. Cl.[7] ..... A63H 33/08
(52) U.S. Cl. ..... 446/128; 446/118
(58) Field of Search ..... 446/128, 118, 446/117, 108, 127

(56) References Cited

U.S. PATENT DOCUMENTS 3,078,616 A * 2/1963 Selwyn-Smith ..... 446/118
3,594,940 A * 7/1971 Yonezawa ..... 446/118
3,895,456 A * 7/1975 Fabre ..... 446/128
4,164,091 A 8/1979 Lin
4,272,274 A * 6/1981 Frank et al. ..... 65/273
4,306,372 A * 12/1981 Lin ..... 446/118
4,964,802 A 10/1990 Weller
5,004,491 A * 4/1991 McMaster et al. ..... 65/106

FOREIGN PATENT DOCUMENTS

DE 24 14 246 * 10/1975 ..... 446/118
DE 33 03 430 A1 8/1984
DK 129080 8/1974

* cited by examiner

*Primary Examiner*—Derris H. Banks
*Assistant Examiner*—Urszula M Cegielnik
(74) *Attorney, Agent, or Firm*—Pitney, Hardin, Kipp & Szuch LLP

(57) ABSTRACT

A vacuum-shaped toy building plate with a substantially plane building surface arranged with coupling means for being interconnected with toy building elements having complementary coupling means. The toy building plate is also provided with downwardly protruding spacer elements intended for imparting to said toy building plate a certain height. Along its periphery the toy building plate is also provided with a downwardly protruding flange having the same downward extent as said spacer elements.

6 Claims, 2 Drawing Sheets

THERMOFORMED TOY BUILDING PLATE

Figure 1:
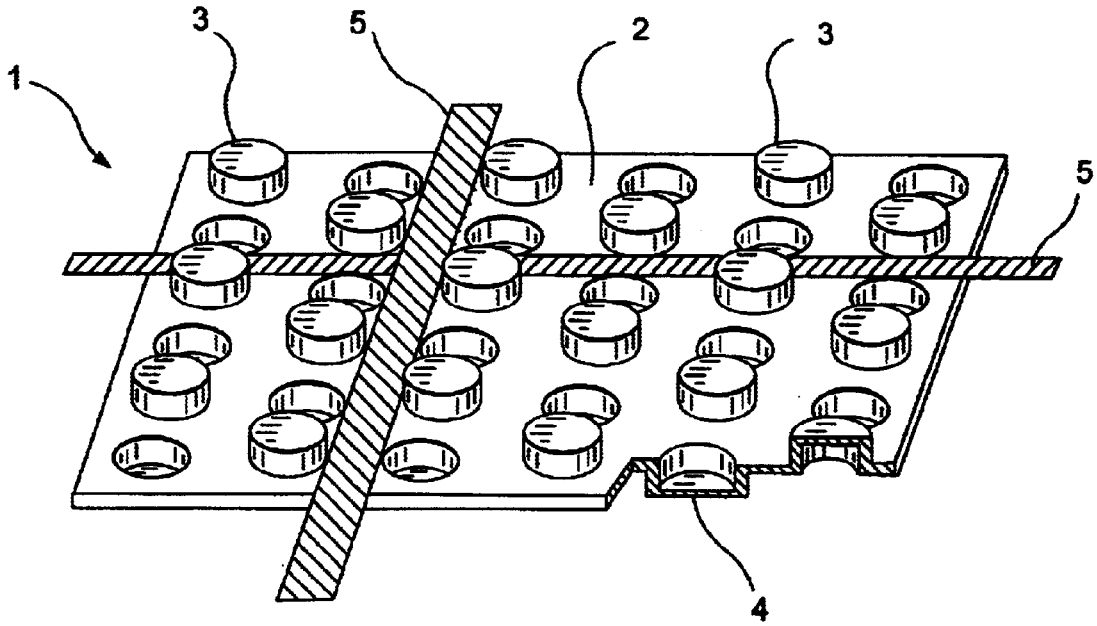
FIG. 1 PRIOR ART

The invention relates to a vacuum-shaped toy building plate with a substantially plane building surface provided with coupling means for being interconnected with toy building elements with complementary coupling means, said toy building plate also being provided with downwardly protruding spacer elements in the form of respective skirts which are, at their downmost ends, closed and, at their uppermost ends, open for imparting a certain height to said toy building plate.

Vacuum-shaped toy building plates are generally known in a form where most often they have a plane underside and a top surface provided with coupling means, e.g. in the form of cylindrical coupling studs. During play, these toy building plates are positioned on a plane support while being used as a basis for the construction of more comprehensive structures consisting of further toy building elements.

The plates are made of a comparatively readily bendable plastics material which is suitable for vacuum-shaping and since they are made with a comparatively small material thickness in order to maintain adequate tolerance on the coupling studs, the finished plates are also readily bendable.

Vacuum-shaping is a comparatively inexpensive manufacturing method and it is desired to be able to employ such process for the manufacture toy building plates which do not only consist of a plane surface with upwardly protruding coupling studs but also have a certain height and rigidity. Such toy building plates would provide a good alternative or supplement to other toy building elements that are typically made by injection moulding.

DK-B-129,080 teaches a toy building plate made of a thin plastics material, said toy building plate being provided with coupling means in the form of cylindrical coupling studs that protrude from both sides. This prior art toy building plate is primarily intended for being cut into smaller portions to form smaller toy building elements. Since the material thickness is small, the toy building elements made will be comparatively easily bent which is also one of the objects of these prior art toy building elements. The coupling studs of the toy building plate are arranged in regular rows which means that plane areas are provided between the rows that inherently serve as bending lines which make the cut-out toy building elements easy to bend along said plane areas between the rows of coupling studs.

If a toy building plate or toy building elements made from the toy building plate is/are used on a plane support, the downwardly protruding coupling studs impart a certain height to the plate/element but there is a risk that the plate/element tips if building is performed close to the edge of the plate/element since there are no supports along the edge but only further towards the centre of the plate/element.

It is the object of the present invention to provide a vacuum-shaped toy building plate of a certain height and exhibiting an increased rigidity compared to vacuum-shaped toy building plates known in the art, and which is stable no matter where on the building surface building is carried out.

This is obtained by configuring the toy building plate featured in the introductory part in such a manner that, along its periphery, the toy building plate is provided with a downwardly protruding flange having the same downward extent as said spacer elements.

Hereby a toy building plate is obtained that exhibits a higher degree of rigidity than the prior art toy building plates and which is also more stable for building purposes since the downwardly protruding flange and the spacer elements have the same extent downwards which means that the interior edge of the toy building plate as well as its exterior edge are supported when used on a plane support.

Preferably said coupling means in the building surface of the toy building plate are arranged in rows and the downwardly protruding spacer elements are so positioned that at least some of the natural bending lines, i.e. the plane areas between the rows of coupling means, are interrupted. Hereby further rigidity is imparted to the toy building plate.

According to a further embodiment, the downwardly protruding spacer elements are in the form of coupling studs for interconnecting with toy building elements having complementary coupling means. Such downwardly protruding spacer elements enable novel building opportunities since the toy building plates may hereby be mounted on top of other toy building elements.

The coupling means in the building surface of the toy building plate are preferably each in the form of a cylindrical coupling stud or one central coupling stud with an outer coupling area situated around same.

Figure 2:
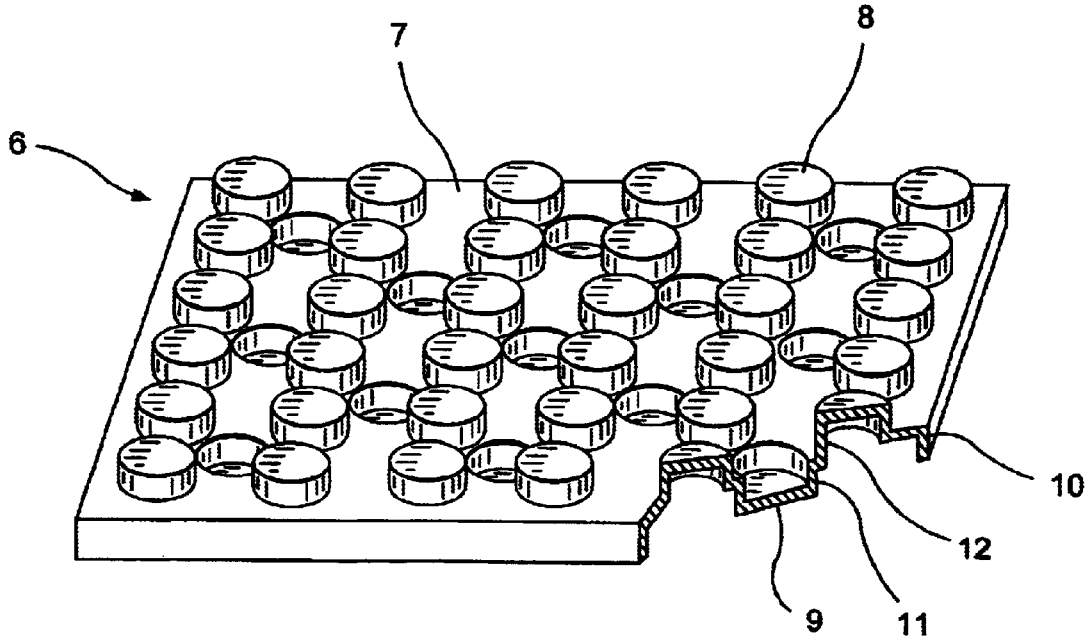
Figure 3:
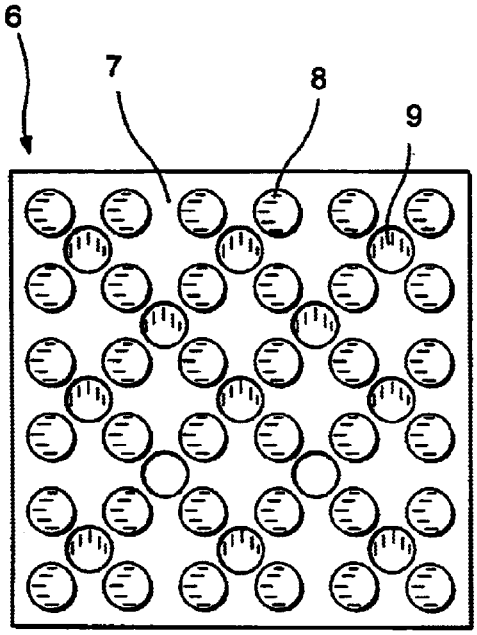
Figure 4:
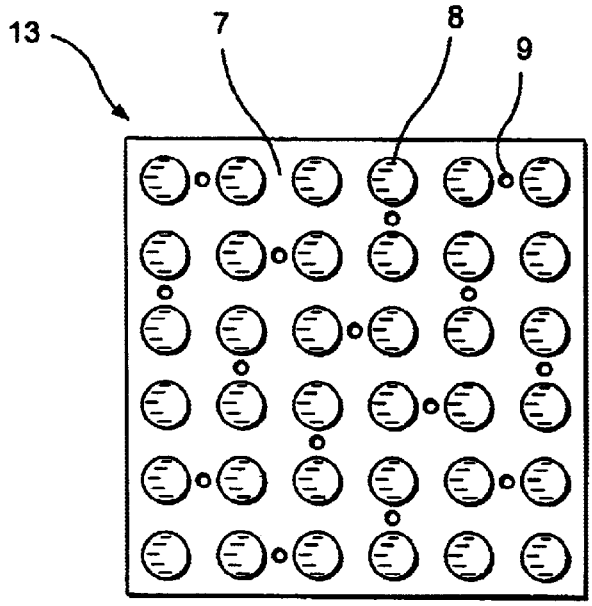
Figure 5:
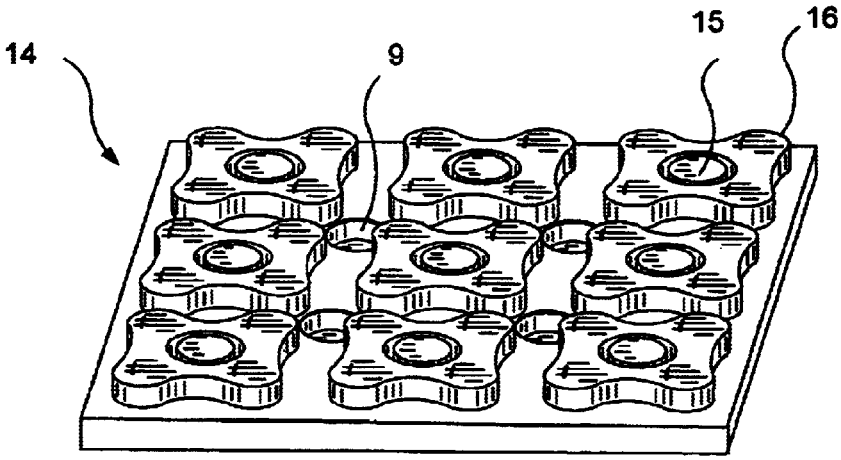

The invention will now be explained in further detail with reference to the accompanying drawings, wherein FIG. 1 is a partially sectional view of a prior art toy building plate, FIG. 2 is a partially sectional view of the toy building plate according to the invention, FIGS. 3 and 4 illustrate various positionings for the downwardly facing spacer elements, and FIG. 5 illustrates a further, alternative embodiment of a toy building plate according to the invention.

FIG. 1 illustrates a vacuum-shaped toy building plate 1 as taught by DK-A-129,080 wherein a corner has been cut off to allow a cross sectional view of the toy building plate 1.

The toy building plate 1 comprises a building surface 2 provided with upwardly protruding coupling means in the form of coupling studs 3 and with corresponding downwardly protruding coupling studs 4. The coupling studs 3,4 are arranged in rows and are positioned equidistantly with regard to the respective rows as well as to the individual coupling studs 3,4 in each row. The building plate 2 as such is constituted by the plate material between the coupling studs 3,4 and as indicated by the hatched belt, uninterrupted belts of plane regions 5 occur between the rows of coupling studs 3,4. The toy building plate 1 is made of a comparatively thin plastics material and therefore at is readily bent along the plane areas 5 that constitute natural bending lines for the toy building plate.

FIG. 2 illustrates a toy building plate 6 according to the invention. Like the toy building plate 1 shown in FIG. 1, the toy building plate 6 comprises a building surface 7 provided with upwardly protruding coupling means in the form of coupling studs 8 and with downwardly protruding spacer elements 9 that may be provided in the form of actual coupling studs which feature, however, is not decisive to the invention.

As will appear, the toy building plate 6 is provided with a downwardly protruding flange 10 along its periphery, and the downward extent of this flange 10 corresponds to the extent of the spacer elements 9 thereby allowing the toy building plate 6 to use its flange 10 as well as its spacer elements 9 as support when arranged on a plane support which will often be the case during play with the toy building plate.

The flange 10 along the periphery imparts increased rigidity to the toy building plate 6 compared to the toy building plate 1 according to the prior art. In addition to this, the flange 10 has a stabilising effect when the toy building plate 6 is used as support when other toy building elements are used for building purposes, since it establishes support along the entire periphery thereby preventing the toy building plate 6 from tipping about the outermost downwardly protruding spacer elements 9.

According to a preferred embodiment, the downwardly protruding spacer elements 9 are so arranged that at least some of the plane areas 5 known from the prior art shown in FIG. 1 are interrupted by the spacer elements 8. Hereby increased rigidity is imparted to the toy building plate 6, since one or more of the natural bending lines is/are hereby interrupted.

In the embodiment shown in FIG. 2, the spacer elements 9 are arranged in the diagonal between the upwardly protruding coupling studs 8. This positioning serves to ensure that each of the spacer elements interrupts a through-going plane area 5 in two mutually perpendicular directions.

Moreover the diameter of the spacer elements 9 is so dimensioned that their vertical wall portions 11 continue upwards into—or at least substantially continue upwards into—the vertical wall portions 12 of the coupling studs 8 as shown in the cross section of FIG. 2. This configuration of the toy building plate 6 means that no uninterrupted plane areas occur in the diagonal direction between the coupling studs 8.

In FIG. 3, the toy building plate 6 is illustrated from above, and the building surface 7, the coupling studs 8 and the spacer elements 9 will appear clearly. The regular distribution of the spacer elements 9 across the toy building plate 6 will appear clearly since they are arranged in the diagonal direction between the coupling studs 8. This positioning in combination with their diameters mean that no plane areas 5 that extend all the way across the toy building plate 6 between the rows of coupling studs 8, a feature that imparts a considerably increased rigidity to the toy building plate 6.

FIG. 4 illustrates an alternative toy building plate 13 in which the positioning and dimensions of the spacer elements 9 have been changed, each of them having a smaller diameter and being arranged between two coupling studs in the same row. This positioning of the spacer elements 9 interrupts the through-going plane areas 5, too, thereby imparting increased rigidity to the toy building plate 13.

FIG. 5 illustrates a further alternative embodiment of the toy building plate 14 according to the invention. In this embodiment, the coupling studs on the top surface of the toy building plate 14 have a configuration that differs substantially from the embodiments shown in FIGS. 1–4. Here the coupling studs consist of a central coupling stud 15 and an outer coupling area 16 located about same. The spacer elements 9 are arranged between the outer coupling areas 16 and with the diameter shown of the spacer elements 9, the plane areas 5 have been interrupted.

The positioning and dimensions of the spacer elements 9 may of course be varied as desired, their primary object being to create a distance to the support when the toy building plate is used. If a higher degree of rigidity is desired than the one imparted to the toy building plate by the flange 10 along its periphery, the spacer elements 9 may advantageously be so configured and positioned that their extent interrupt the plane areas 5 known from the prior art.

The examples exclusively feature circular spacer elements 9 but, of course, they may also have other configurations, e.g. be in the shape of elongated areas between the coupling studs.

What is claimed is:

1. A vacuum-shaped toy building plate with a flexible plane building surface, said toy building plate comprising:

upwardly protruding coupling studs for being interconnected with toy building elements with coupling means which are complementary to said coupling studs, and downwardly protruding spacer elements providing height to the toy building plate, said spacer elements being in the form of downwardly extending columns which are, at their downmost ends, closed and, at their uppermost ends, open, wherein along its periphery, the toy building plate is provided with a downwardly protruding flange having the same downward extent as said spacer elements, and wherein, in relation to at least one straight edge of the toy building plate, said coupling studs are arranged in a minimum of one row parallel with said straight edge, at least one of said spacer elements being offset from each of said row(s) of coupling studs.

2. A vacuum-shaped toy building plate according to claim 1 wherein the downwardly protruding spacer elements are in the form of coupling studs for being interconnected with toy building elements having complementary coupling means.

3. A vacuum-shaped toy building plate according to claim 1 wherein each of said upwardly extending coupling studs is in the form of a cylindrical coupling stud.

4. A vacuum-shaped toy building plate according to claim 3, wherein an area of the plane building surface around each of said cylindrical coupling studs protrude upwards to form an outer coupling area that is connectable with toy building elements with coupling means which are complementary to said outer coupling area.

5. A method of manufacturing a toy building plate according to any one of claims 1,3–4 and 7, wherein the toy building plate is manufactured by vacuum-shaping.

6. A vacuum-shaped toy building plate with a flexible plane building surface comprising:

upwardly protruding coupling studs for being interconnected with toy building elements with coupling means which are complementary to said coupling studs, and downwardly protruding spacer elements providing height to the toy building plate, said spacer elements being in the form of downwardly extending columns which are, at their downmost ends, closed and, at their uppermost ends, open, said spacer elements being offset from said coupling studs, wherein along its periphery, the toy building plate is provided with a downwardly protruding flange having the same downward extent as said spacer elements;

each of said upwardly extending coupling studs is in the form of a cylindrical coupling stud, and an area of the plane building surface around each of said cylindrical coupling studs protrude upwards to form an outer coupling area that is connectable with toy building elements with coupling means which are complementary to said outer coupling area.

* * * * *